US009261067B2

(12) United States Patent
Glugla et al.

(10) Patent No.: US 9,261,067 B2
(45) Date of Patent: Feb. 16, 2016

(54) SYSTEM AND METHOD FOR PROVIDING SPARK TO AN ENGINE

(71) Applicant: Ford Global Technologies, LLC, Dearborn, MI (US)

(72) Inventors: Chris Paul Glugla, Macomb, MI (US); Jeffrey Allen Doering, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 234 days.

(21) Appl. No.: 13/867,539

(22) Filed: Apr. 22, 2013

(65) Prior Publication Data

US 2014/0316673 A1 Oct. 23, 2014

(51) Int. Cl.

| | |
|---|---|
| ***F02P 9/00*** | (2006.01) |
| ***F02P 3/05*** | (2006.01) |
| ***F02D 41/00*** | (2006.01) |
| *F02P 15/08* | (2006.01) |
| *F02D 17/02* | (2006.01) |
| *F02P 7/03* | (2006.01) |
| *F02P 5/152* | (2006.01) |
| *F02D 35/02* | (2006.01) |

(52) U.S. Cl.

CPC ..... *F02P 9/002* (2013.01); *F02D 41/0087* (2013.01); *F02P 3/051* (2013.01); *F02D 17/02* (2013.01); *F02D 35/023* (2013.01); *F02D 2200/021* (2013.01); *F02P 5/1522* (2013.01); *F02P 7/03* (2013.01); *F02P 15/08* (2013.01); *Y10S 903/902* (2013.01)

(58) Field of Classification Search

CPC ..... F02P 9/002; F02P 15/08; F02P 7/03; F02P 5/1522; F02D 17/02; F02D 41/0087

USPC ..... 123/481, 198 F, 605, 618, 636, 406.2; 701/102

See application file for complete search history.

(56) References Cited

U.S. PATENT DOCUMENTS

| | | | | |
|---|---|---|---|---|
| 3,716,037 | A * | 2/1973 | Jacobs | 123/598 |
| 5,617,829 | A * | 4/1997 | Bidner et al. | 123/481 |
| 7,255,080 | B1 * | 8/2007 | Leone | 123/169 PB |
| 7,533,651 | B2 * | 5/2009 | Surnilla | 123/304 |
| 7,574,989 | B2 * | 8/2009 | Nakamura et al. | 123/179.4 |
| 7,665,452 | B2 * | 2/2010 | Russell et al. | 123/638 |
| 8,402,942 | B2 * | 3/2013 | Tripathi et al. | 123/350 |
| 2013/0241429 | A1 * | 9/2013 | Ruan et al. | 315/220 |

FOREIGN PATENT DOCUMENTS

| | | | | |
|---|---|---|---|---|
| GB | 2255372 | A * | 11/1992 | F02P 15/00 |

* cited by examiner

*Primary Examiner* — Stephen K Cronin
*Assistant Examiner* — Kevin R Steckbauer
(74) *Attorney, Agent, or Firm* — Julia Voutyras; Alleman Hall McCoy Russell & Tuttle LLP

(57) ABSTRACT

An approach for supplying spark to a spark ignited engine having activated and deactivated engine cylinders is disclosed. In one example, the approach increases ignition energy supplied to spark plugs of deactivated cylinders to reduce the possibility of spark plug fouling for the deactivated cylinders while continuing to supply spark to activated cylinders.

19 Claims, 5 Drawing Sheets

SYSTEM AND METHOD FOR PROVIDING SPARK TO AN ENGINE

FIELD

The present description relates to a system and method for supplying spark to engine cylinders. The approach may be particularly useful for engines that may have cylinders that are temporarily deactivated.

BACKGROUND AND SUMMARY

Fuel efficiency of an engine may be improved by temporarily deactivating selected cylinders of the engine. The engine cylinders may be deactivated by stopping fuel flow and spark to the engine cylinders. Once a portion of the engine cylinders are deactivated, the engine's active cylinders may provide an equivalent amount of torque as compared to when all cylinders are operating, and the active cylinders may operate at a higher volumetric efficiency. Further, the engine may operate with less pumping losses when a portion of engine cylinders are deactivated. However, residual fuel and oil in a deactivated cylinder may accumulate on the cylinder's spark plug such that the spark plug fouls and may not provide a desirable spark when an attempt is made to reactivate the cylinder. Consequently, engine emissions and torque production may degrade.

The inventors herein have recognized the above-mentioned disadvantages and have developed a method for providing spark to an engine, comprising: operating a first group of cylinders and deactivating a second group of cylinders, the second group of cylinders deactivated via stopping spark and fuel flow to the second group of cylinders; and providing spark without providing fuel to a cylinder of the second group of cylinders a predetermined duration after the second group of cylinders is deactivated.

The possibility of spark plug fouling for spark plugs of deactivated cylinders may be decreased by periodically reactivating spark in the cylinder without resuming fuel flow to the deactivated cylinder. Further, in some examples, the amount of energy supplied to the spark plug when the cylinder is deactivated may be increased compared to an amount of energy supplied to the spark plug when the engine is operated at the same speed and load with all cylinders activated. The additional energy may help to remove hydrocarbons and/or carbonaceous soot that may form on a spark plug. In this way, it may be possible to reduce the possibility of fouling spark plugs in cylinders that have been deactivated.

The present description may provide several advantages. For example, the approach may reduce the possibility of spark plug fouling in deactivated cylinders. Further, portions of the approach may be applied in response to a request to deactivate cylinders so that the cylinders may be deactivated for a longer period of time before energy is supplied to spark plugs in a cylinder that is not combusting an air-fuel mixture. Thus, the approach may preemptively address potential spark plug fouling for deactivated cylinders.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading the Detailed Description, when taken alone or with reference to the drawings, where.

DETAILED DESCRIPTION

Figure 1:
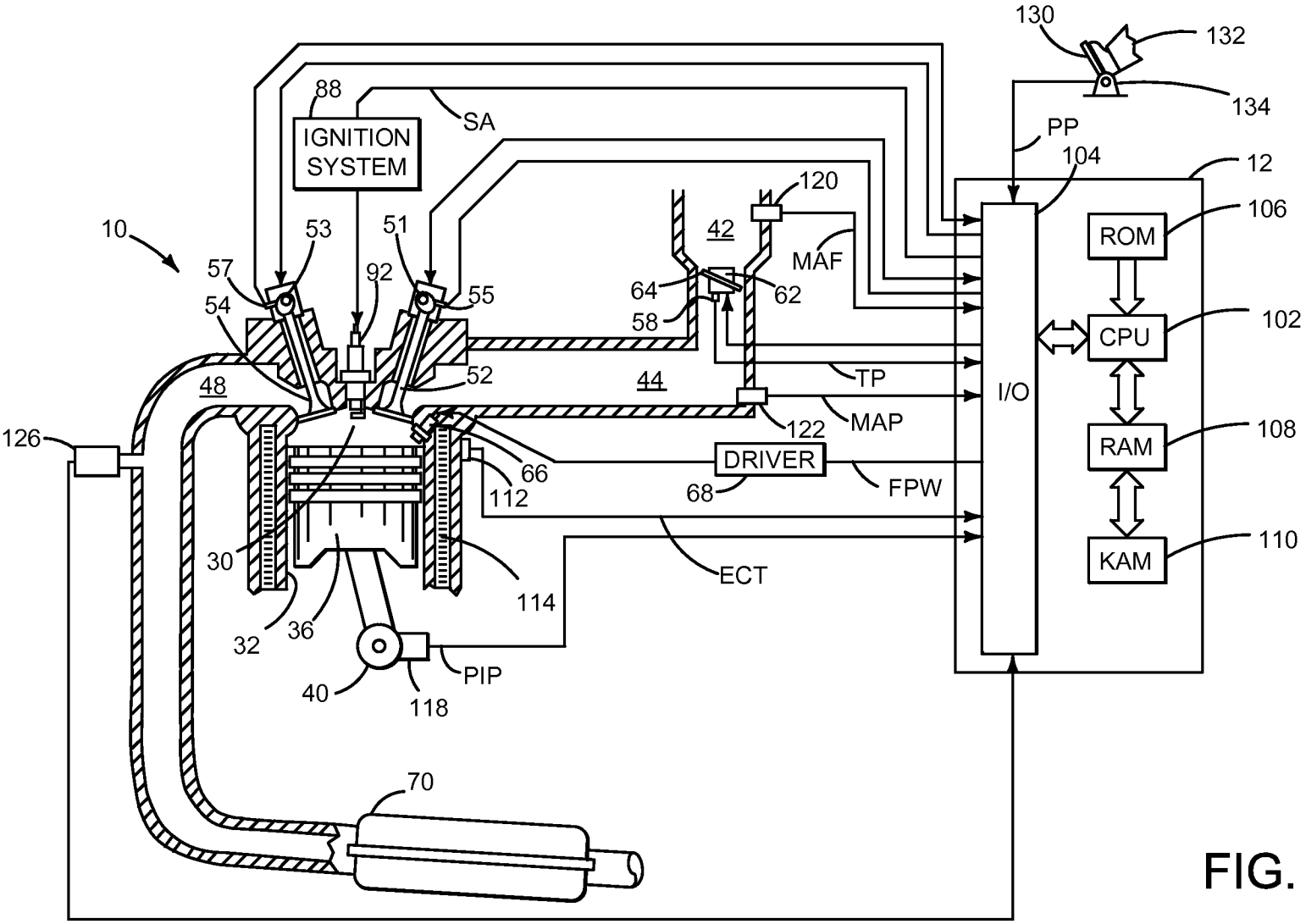
FIG. 1 is a schematic diagram of an engine.
Figure 2:
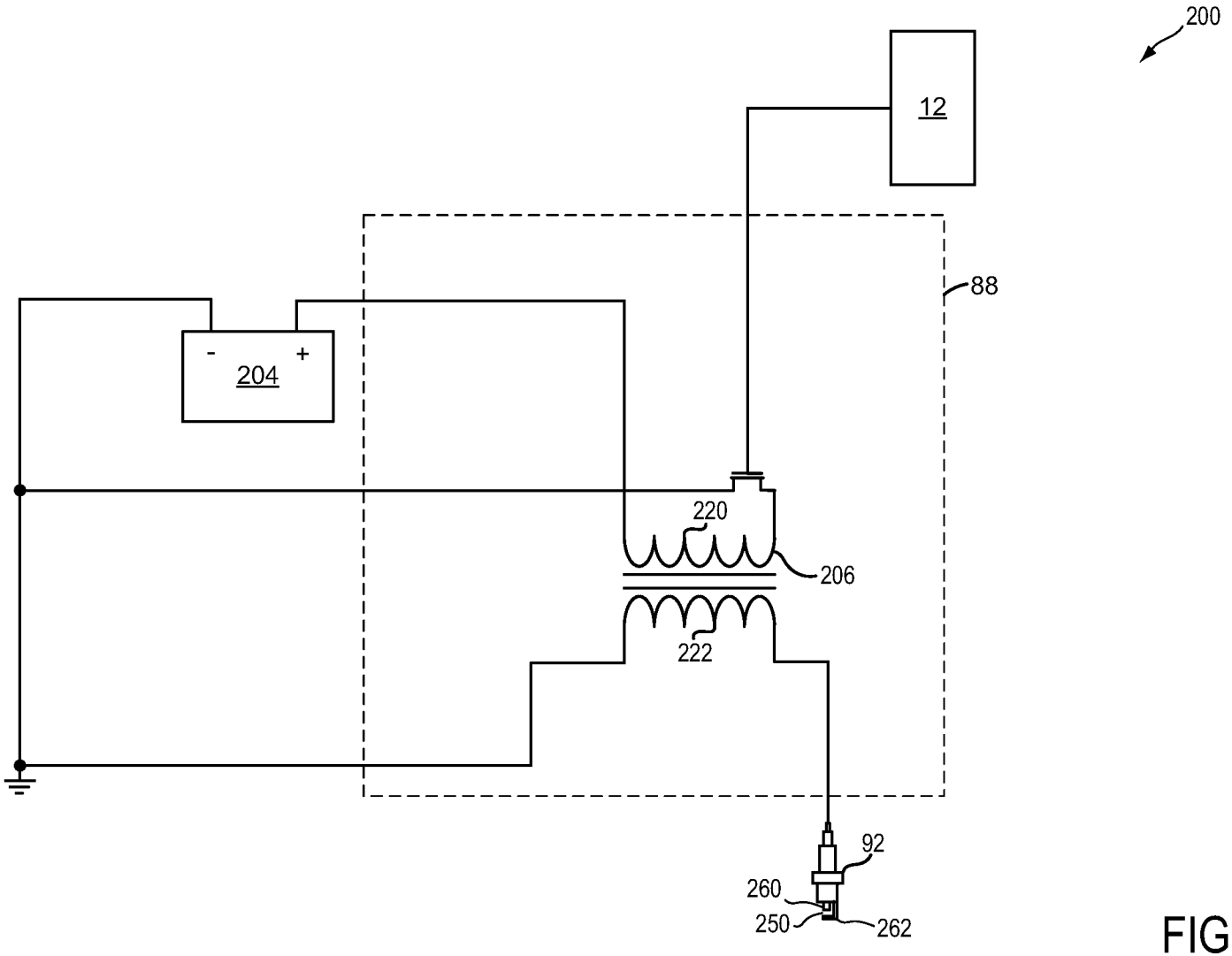
FIG. 2 is a schematic diagram of a first example ignition system.
Figure 3:
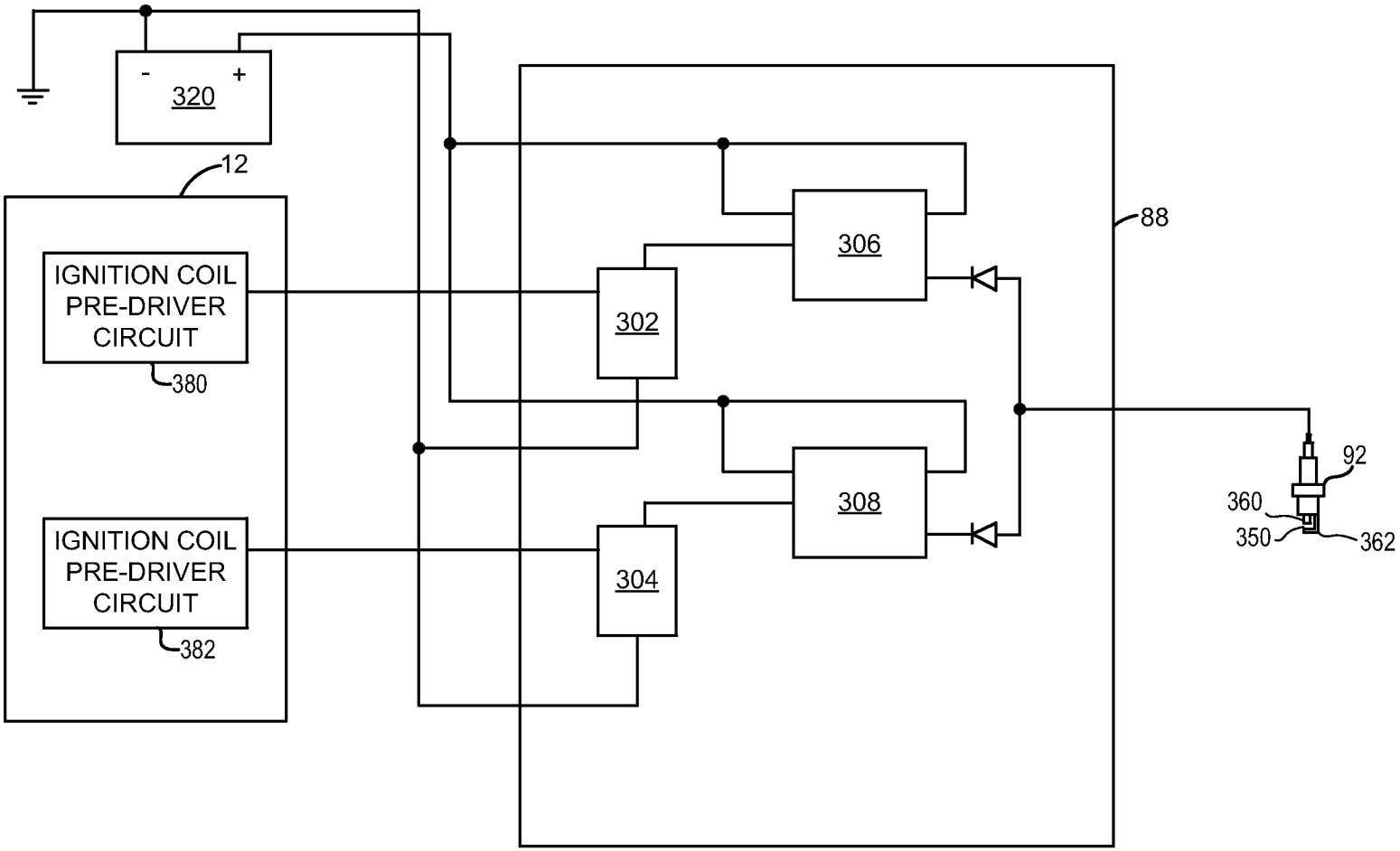
FIG. 3 is a schematic diagram of a second example ignition system.

The present description is related to improving operation of an engine that includes cylinders that are selectively deactivated. In particular, approaches for reducing the possibility of spark plug fouling are provided. In one non-limiting example, the engine may be configured as illustrated in FIGS. 1-3. Hydrocarbons and/or carbonaceous soot may be removed or reduced as illustrated in sequence of FIG. 4. The method of FIG. 5 provides different options for reducing the possibility of spark plug fouling for engine cylinders that may be selectively deactivated.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, a detailed view of a portion of an example ignition system for supplying spark to a cylinder is shown. The circuit of FIG. 2 may be included in the system of FIG. 1. Further, the ignition system of FIG. 2 may be used to provide the sequence shown in FIG. 4.

Battery 204 supplies electrical power to ignition system 88 and controller 12. Controller 12 operates switch 202 to charge and discharge ignition coil 206. The amount of energy stored in ignition coil 206 depends on battery voltage and the amount of time switch 202 is closed. The amount of time switch 202 is closed may be referred to as a dwell time. Ignition coil 206 includes primary coil 220 and secondary coil 222. Ignition coil 206 charges when switch 202 closes to allow current to flow from battery 204 to ignition coil 206. Ignition coil 206 discharges when switch 202 opens after current has been flowing to ignition coil 206.

Secondary coil 222 supplies energy to spark plug 92. Spark plug 92 generates a spark when voltage across electrode gap 250 is sufficient to cause current to flow across electrode gap 250. Spark plug 92 includes center electrode 260 and a side electrode 262. Voltage is supplied to center electrode 360 via secondary coil 322. Side electrode 362 is electrically coupled to ground. The amount of energy output from ignition coil 206 to spark plug 92 and converted into spark energy may be increased via increasing the dwell time or ignition coil charging time. Similarly, the amount of energy output from ignition coil 206 to spark plug 92 and converted into spark energy may be decreased via reducing the dwell time or ignition coil charging time. Further, multiple sparks may be provided to the deactivated cylinder during an engine cycle to remove matter from the spark plug electrode.

Referring now to FIG. 3, an example of another ignition system is shown. The ignition system of FIG. 3 may be incorporated into the system of FIG. 1. Further, the ignition system of FIG. 3 may be used to provide the sequence shown in FIG. 4.

FIG. 3 is a schematic of an example two coil ignition system. In this example, controller 12 includes two ignition coil pre-driver circuits 380 and 382, one for each ignition coil that may be operated to supply electrical energy to a spark plug of a single cylinder. The two ignition coil pre-driver circuits 380 and 382 supply low level current to ignition coil drivers 302 and 304. Ignition coil drivers 302 and 304 are included in ignition system 88 which may be positioned on top of or near spark plug 92. First ignition coil pre-driver circuit 380 may supply a signal to first ignition coil driver 302. First ignition coil 306 is selectively supplied current via first coil driver 302. Electric energy storage device 320 sources electrical current to first ignition coil 306. Similarly, second ignition coil pre-driver circuit 382 may supply a signal to second ignition coil driver 304. Second ignition coil 308 is selectively supplied current via second coil driver 304. Electric energy storage device 320 sources electrical current to second ignition coil 308.

Spark plug 92 may be supplied electrical energy from first ignition coil 306 and/or second ignition coil 308. Spark plug 92 includes a first electrode 360 and a second electrode 362. Second electrode 362 may be in continuous electrical communication with ground. A spark may develop across gap 350 when an electrical potential difference exists between first electrode 360 and second electrode 362.

In one example, ignition coil pre-driver circuits 380 and 382 activate ignition coil drivers 302 and 304 so that ignition coils 306 and 308 are charged at the same time. The ignition coils may be discharged at the same time or successively such that one ignition coil is discharging when the second coil begins to discharge. In this way, the amount and duration of energy supplied to spark plug 92 during a cylinder cycle may be increased. Furthermore, although FIG. 3 shows two coils per spark plug, the system may include from 1-N coils per spark plug.

Thus, the system of FIGS. 1-3 provides for supplying spark to an engine, comprising: an engine including a first group of cylinders and a second group of cylinders; an ignition system including a first group of spark plugs positioned in the first group of cylinders and a second group of spark plugs positioned in the second group of cylinders; and a controller including executable instructions stored in non-transitory memory for supplying spark and fuel to the first and second groups of cylinders, deactivating the second group of cylinders via stopping spark and fuel flow in the second group of cylinders, operating the engine at a speed and load while the second group of cylinders is deactivated, and increasing an amount of ignition energy supplied to the second group of cylinders after deactivating the second group of cylinder, the amount of ignition energy increased to an amount of ignition energy that is greater than if the engine is operating at the speed and load with the first and second group of cylinders activated.

In one example, the system includes where the amount of ignition energy supplied to the second group of cylinders is increased after a predetermined duration since deactivating the second group of cylinders. The system includes where the predetermined duration is a number of engine cycles. The system includes where the number of engine cycles varies with engine operating conditions. The system further comprises additional instructions for increasing the amount of ignition energy in response to a request to deactivate the second group of cylinders while the second group of cylinders is operating. The system includes where the ignition system includes two ignition coils per spark plug.

Figure 4:
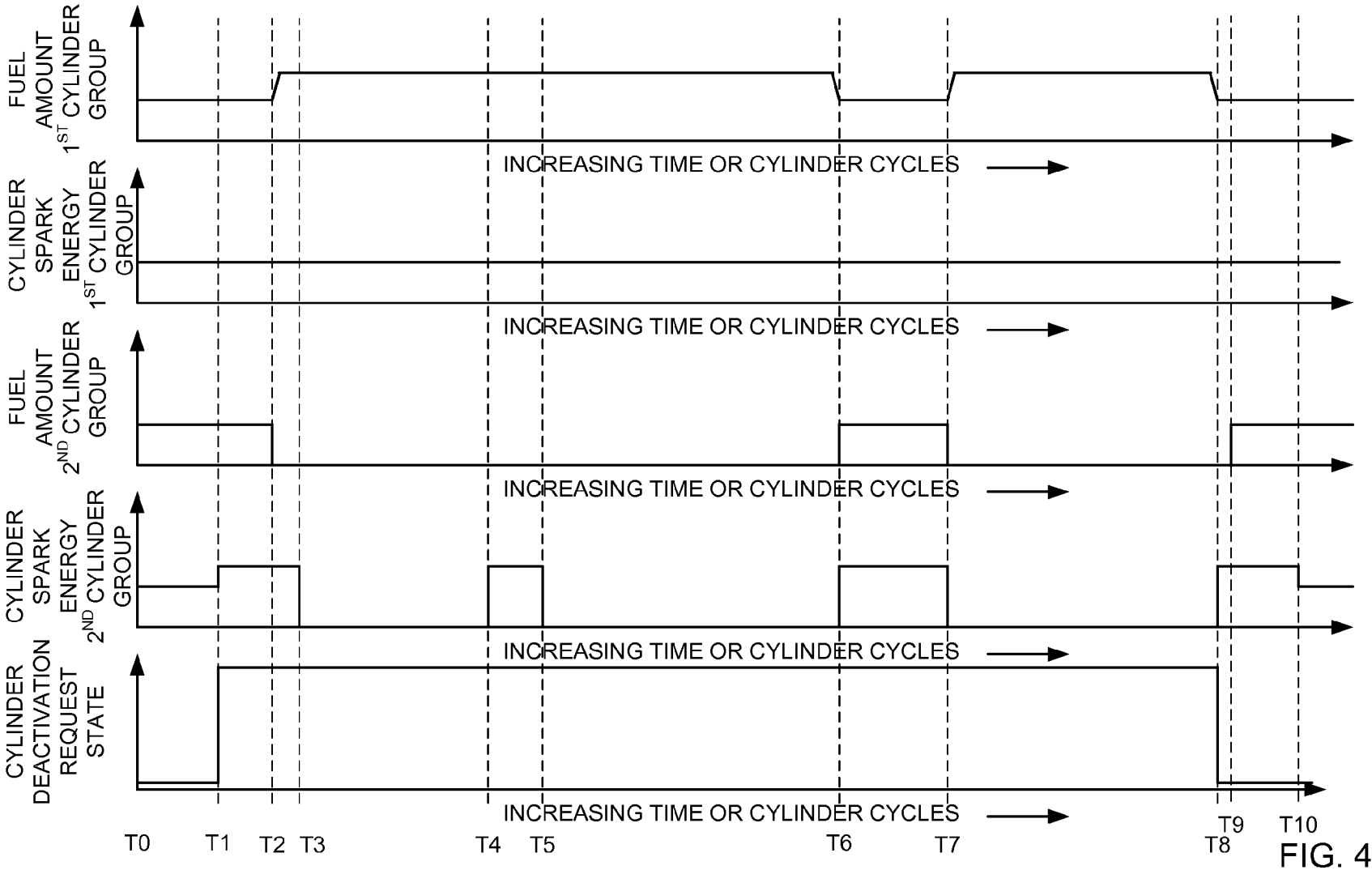
FIG. 4 is an example plot of signals of interest during cylinder deactivation.
Figure 5:
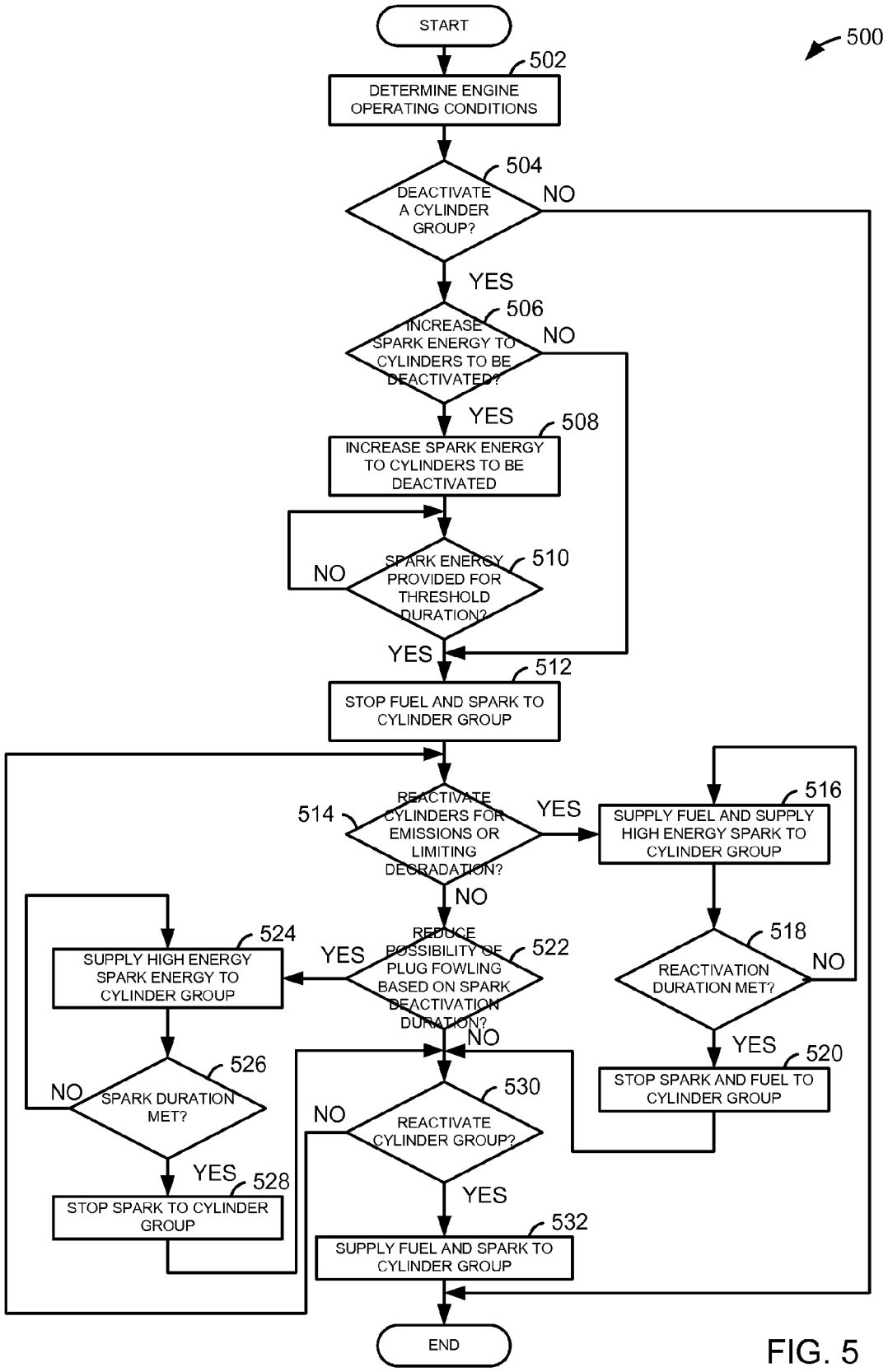
FIG. 5 is a flow chart of an example method for supplying spark to an engine.

Referring now to FIG. 4, an example sequence for supplying spark to engine cylinders is shown. The sequence of FIG. 4 may be provided by the system of FIGS. 1-3 executing the method of FIG. 4. Vertical markers T0-T10 represent times of particular interest during the sequence.

The first plot from the top of FIG. 4 represents an amount of fuel supplied to each cylinder of a first group of cylinders in a cylinder cycle. The X axis represents time or alternatively a number of cylinder or engine cycles. The Y axis represents an amount of fuel supplied to each cylinder of the first group of cylinders in a cylinder cycle and the amount of fuel supplied to a cylinder during a cylinder cycle increases in the direction of the Y axis arrow.

The second plot from the top of FIG. 4 represents an amount of spark energy supplied to each cylinder of a first group of cylinder in a cylinder cycle. The X axis represents time or alternatively a number of cylinder or engine cycles. The Y axis represents an amount of spark energy supplied to each cylinder of a first group of cylinders in a cylinder cycle and the amount of spark energy supplied to a cylinder during a cylinder cycle increases in the direction of the Y axis arrow.

The third plot from the top of FIG. 4 represents an amount of fuel supplied to each cylinder of a second group of cylinders in a cylinder cycle. The X axis represents time or alternatively a number of cylinder or engine cycles. The Y axis represents an amount of fuel supplied to each cylinder of the second group of cylinders in a cylinder cycle and the amount of fuel supplied to a cylinder increases in the direction of the Y axis arrow.

The fourth plot from the top of FIG. 4 represents an amount of spark energy supplied to each cylinder of a second group of cylinder in a cylinder cycle. The X axis represents time or alternatively a number of cylinder or engine cycles. The Y axis represents an amount of spark energy supplied to each cylinder of a second group of cylinders in a cylinder cycle and the amount of spark energy supplied to a cylinder during a cylinder cycle increases in the direction of the Y axis arrow.

The fifth plot from the top of FIG. 4 represents a cylinder deactivation request state. Cylinders in the second group of cylinders are commanded to a deactivated state after the cylinder deactivation request is transitioned to a higher level. Cylinders in the second group of cylinders are commanded to an activated state after the cylinder deactivation request is transitioned to a lower level.

At time T0, fuel and spark are being supplied to the first cylinder group and the second cylinder group as indicated by the fuel amount supplied to the first cylinder group, the fuel amount supplied to the second cylinder group, the spark energy supplied to the first cylinder group, and the spark energy supplied to the second cylinder group. Further, the cylinder deactivation request state is at a lower level indicating that the second group of cylinders has not been requested to be deactivated.

At time T1, the cylinder deactivation request state transitions to a higher level to request deactivation of the second cylinder group. The cylinder deactivation request may be in response to a change in engine temperature, engine speed, engine load, or other condition. The cylinder spark energy supplied to the second group of cylinders increases. By increasing spark energy before the second group of cylinders is deactivated, carbonaceous soot, oil, or other spark plug fouling material may be removed from the spark plugs before the second cylinder group is deactivated so that cylinders in the second group of cylinders may be deactivated for a longer duration. In other examples, spark energy supplied to the second group of cylinders is not increased before the second group of cylinders is deactivated. In one example, spark energy supplied to the second group of cylinders may be based on an accumulated spark plug soot model or an amount of time or cylinder cycles the second cylinder group has been operated without operating at a higher spark energy level. The spark energy is increased to an amount of spark energy that is greater than the amount of spark energy supplied to the second group of cylinders when the engine is operating at the same speed and load without any spark energy adjustment amounts for material removal from the spark plugs. Fuel supplied to the first and second cylinder groups remains at same level which is based on engine speed and load. Spark energy supplied to the first group of cylinders remains at a level it was before time T1.

At time T2, fuel to the second group of cylinders is deactivated which stops combustion in the second group of cylinders. Fuel flow to the second group of cylinders may be stopped after a predetermined number of engine cycles after the cylinder deactivation request or in response to other engine conditions. The fuel amount supplied to the first cylinder group increases so that the engine continues to output the same torque before the second group of cylinders was deactivated as after the second group of cylinders is deactivated. The amount of air supplied to the first group of cylinders (not shown) also increases so that the same level of engine output torque may be provided. The amount of spark energy supplied to the first group of cylinders remains at a same level as before the second group of cylinders was deactivated.

At time T3, spark to the second group of cylinders is deactivated in response to the cylinder deactivation request and a number of cylinder cycles since the cylinder deactivation request was asserted or other engine condition. The fuel flow supplied to the second group of cylinders remains stopped and the cylinder deactivation request state remains at a higher level to indicate that cylinders in the second group of cylinders are requested to be in a deactivated state. Fuel flow and amount of spark energy supplied to the first group of cylinders remains at the same level since time T2.

Between time T3 and time T4, all the conditions of the five plots remain at constant levels. However, in some examples the conditions may change from time to time depending on operating conditions.

At time T4, spark to the second group of cylinders is reactivated, and the amount of spark energy supplied to the cylinders of the second group is increased as compared to if the engine were operating at the same speed and load without attempting to remove carbonaceous soot from the spark plugs. The spark in deactivated cylinders may be activated in response to a number of cylinder cycles, a spark plug soot model, or other condition indicative of increasing the potential for spark plug fouling in the deactivated cylinders (e.g., oil or fuel accumulation). Fuel delivery to the second group of cylinders remains stopped. The spark energy and fuel amount supplied to the first group of cylinders remains at the same level since time T2. Additionally, the cylinder deactivation request state remains at a higher level so that cylinders in the second group of cylinders do not combust air-fuel mixtures.

At time T5, spark to the second group of cylinders is deactivated. The spark in the second group of cylinders may be deactivated a predetermined number of cylinder or engine cycles since the spark was activated at time T4. The spark and fuel delivered to the first group of cylinders remains constant and fuel flow to the second group of cylinders remains stopped. Also, the cylinder deactivation request state remains at a higher level so that cylinders in the second group remain deactivated.

Between time T5 and time T6, all the conditions of the five plots remain at constant levels. However, in some examples the conditions may change from time to time depending on operating conditions.

At time T6, cylinders in the second group of cylinders are reactivated. The cylinders in the second group may be reactivated when it may be expected that cylinder temperatures or a temperature of an exhaust after treatment device is less than a threshold temperature. The amount of spark energy supplied to the second group of cylinders when they are reactivated is greater than an amount of spark energy that would be supplied to the second group of cylinders when not attempting to reduce the possibility of spark plug fouling. The cylinder deactivation request state remains at a higher level, but in other examples the cylinder deactivation request state may transition to a lower level when the cylinder are reactivated. In this example, engine speed and load are at a lower level where the second group of cylinder would be deactivated but for cylinder or after treatment device temperature. Consequently, the cylinder deactivation state remains at a higher level. The spark energy supplied to the first group of cylinders remains constant, but the fuel amount supplied to cylinders in the first group of cylinders is decreased so that engine torque may be maintained at a constant value while cylinders in the second group are reactivated.

At time T7, cylinders in the second group of cylinders are deactivated. The cylinders in the second group may be deactivated when it may be expected that cylinder temperatures or a temperature of an exhaust after treatment device is greater than a threshold temperature, or when material is expected to be removed from spark plus in the second group of cylinders. The cylinder deactivation request state remains at a higher level. The spark energy supplied to the first group of cylinders remains constant, but the fuel amount supplied to cylinders in the first group of cylinders is decreased so that engine torque may be maintained at a constant value while cylinders in the second group are reactivated.

Between time T7 and time T8, all the conditions of the five plots remain at constant levels. However, in some examples the conditions may change from time to time depending on operating conditions.

At time T8, the cylinder deactivation request state transitions to a lower level to indicated that cylinders in the second group of cylinders are to be reactivated. Cylinders in the second group may be reactivated in response to a change in engine speed, engine load, engine temperature, or other operating condition. Fuel is not supplied to deactivated cylinders, but energy delivered to the spark plug is increased to an amount that is greater than if the engine were operating at the same engine speed and load without adding spark energy to remove matter that may foul the spark plug. The energy supplied to the spark plug is increased so that the cylinder may be reactivated with a higher possibility of operating the cylinder without a misfire. The duration between time T8 and time T9 may be a predetermined amount of time, a predetermined number of engine events (e.g., engine cycles), or based on a measure of indicated spark plug fouling. Further, in some examples, the fuel and spark may be reactivated in the same cylinder cycle when spark plug fouling is not a concern because the spark plug is believed to be relatively clear of fouling matter.

At time T9, the amount of fuel supplied to cylinders in the first group is decreased in response to the change in the cylinder deactivation request state so that engine torque during the transition from deactivated cylinders to all cylinders being active remains substantially constant. Spark energy supplied to cylinders in the first cylinder group remains constant. The amount of spark energy supplied to the second group of cylinders also remains constant. Additionally, fuel flow to the second group of cylinders is resumed to reactivate the deactivated cylinders.

At time T10, the amount of spark energy supplied to the second group of cylinders is decreased to a level of spark energy supplied to engine cylinders at the present engine speed and load when material is not being removed from spark plugs via increasing energy supplied to the spark plug. By decreasing the amount of spark energy, it may be possible to reduce the possibility of degradation to ignition system components. The amount of fuel supplied to the engine remains constant.

In this way, the amount of spark energy supplied to engine cylinders may be varied to reduce the possibility of engine misfires and spark plug fouling. Further, the spark energy supplied to cylinders may be increased before cylinders are deactivated, while cylinders are deactivated, or when cylinders are reactivated to reduce the possibility of spark plug fouling and misfires.

Referring now to FIG. 5, a method for supplying spark to an engine is shown. The method of FIG. 5 may be stored as executable instructions in non-transitory memory of a controller. The method of FIG. 5 may be applied in the system of FIGS. 1-3 to provide the sequence of FIG. 4.

At 502, method 500 determines engine operating conditions. Engine operating conditions may include but are not limited to engine speed, engine load, engine temperature, and after treatment device temperature. Method 500 proceeds to 504 after engine operating conditions are determined.

At 504, method 500 judges whether or not to deactivate a group of engine cylinders. The group of engine cylinders may be one or more engine cylinders. In some examples, a group of engine cylinders may be deactivated in response to engine speed and load. Further, if engine temperature is greater than a threshold temperature, the group of engine cylinders may be deactivated. If method 500 judges that conditions are present to deactivate a group of engine cylinders, method 500 proceeds to 506. Otherwise, method 500 proceeds to exit.

At 506, method 500 judges whether or not to increase an amount of energy supplied to a spark plug of a cylinder that has been requested to deactivate (e.g., stop combustion within the cylinder). In one example, additional energy may be supplied to a spark plug of a cylinder requested to be deactivated based on an estimate of accumulated hydrocarbons and/or carbonaceous soot on the spark plug or a time or number of cylinder cycles since matter was removed from the spark plug to reduce the possibility of spark plug fouling. If method 500 judges that additional energy is to be supplied to the spark plug, method 500 proceeds to 508. Otherwise, method 500 proceeds to 512.

At 508, method 500 increases an amount of energy supplied to spark plugs of cylinders to be deactivated in response to a cylinder deactivation request. In one example, the amount of energy supplied to the spark plug is increased to an amount of energy that facilitates removal of matter from the spark plug. The amount of energy is greater than an amount of energy supplied to the spark plug at the present engine speed and load when additional energy is not being supplied to remove matter from the spark plug. For example, at the time of a transition from all active cylinders to a group of deactivated cylinders when the engine is operating at a particular speed and load, X joules of energy is supplied to a spark plug before the transition to cylinder deactivation and X joules+Y joules of energy is supplied the spark plug to remove matter from the spark plug, noting that Y is positive and non-zero. Method 500 proceeds to 510 after the amount of energy supplied to one or more spark plugs in cylinders requested to be deactivated is increased.

At 510, method 500 judges whether or not the additional amount of energy has been supplied to cylinders requested to be deactivated for a threshold duration. The duration may be a time, a number of engine cycles, a number of cylinder cycles, or another engine condition. If method 500 judges that an additional amount of spark energy has been provided to engine cylinders for a threshold duration, method 500 proceeds to 512. Otherwise, method 500 returns to 510.

At 512, method 500 stops fuel flow and spark to a group of cylinder to be deactivated. However, in some examples, method 500 may stop fuel injection at 506 so that the engine cylinders may continue to receive spark after fuel flow to the cylinders has been deactivated. Spark supplied to the group of cylinders may be stopped via stopping current flow to one or more ignition coils. Fuel flow to engine cylinders may be stopped via shutting off fuel injectors. Method 500 proceeds to 514 after spark and fuel flow to cylinders being deactivated is stopped.

At 514, method 500 judges whether or not to reactivate cylinders for emissions, degradation limiting, or another reason when conditions such as engine speed and load are acceptable for cylinder deactivation. In one example, deactivated cylinders may be reactivated when a temperature of a cylinder or emissions after treatment device is less than a threshold temperature. If method 500 judges that deactivated cylinders are to be reactivated, method 500 proceeds to 516. Otherwise, method 500 proceeds to 522.

At 516, method 500 supplies fuel and an increased amount of spark energy to deactivated engine cylinders, thereby reactivating the cylinders. In one example, the amount of energy supplied to the spark plug is increased to an amount of energy that facilitates removal of matter from the spark plug. The amount of energy is greater than an amount of energy supplied to the spark plug at the present engine speed and load when all cylinders are operating and additional energy is not being supplied to remove matter from the spark plug. For example, X joules of energy is supplied to a spark plug when all engine cylinders are being operated at the present speed and load and X joules+Y joules of energy is supplied the spark plug to remove matter from the spark plug when the cylinders are temporarily reactivated at the present engine speed and load, noting that Y is positive and non-zero and engine torque is maintained at the present engine torque. By simultaneously reactivating cylinders and increasing the amount of energy supplied to spark plugs, method 500 warms engine components and removes matter from spark plugs. Method 500 proceeds to 518 after the amount of energy supplied to one or more spark plugs in cylinders requested to be deactivated is increased.

At 518, method 500 judges whether or not reactivated cylinders have been made active for a desired duration. The desired duration may be an amount of time, a condition when an engine or after treatment temperature is at a threshold level, or some other duration. If method 500 judges that the previously deactivated cylinders have been active for a threshold duration, method 500 proceeds to 520. Otherwise, method 500 returns to 516.

At 520, method 500 stops fuel flow and spark delivery to the group of cylinders desired to be deactivated. By stopping fuel flow and spark to the cylinders, the cylinders are once again deactivated. Method 500 proceeds to 530 after cylinders in a group are deactivated.

At 522, method 500 judges whether or not to reduce the possibility of spark plug fouling in response to a duration of cylinder deactivation or in response to an estimate of fouling matter that has accumulated on a spark plug of a cylinder in which combustion has stopped. In one example, method judges to reduce the possibility of spark plug fouling after the engine has operated with deactivated cylinders for a threshold amount of time or a threshold number of engine cycles. In another example, method 500 judges whether or not to reduce the possibility of spark plug fouling based on a model or measurement of accumulated matter on one or more spark plugs. If method 500 judges to reduce the possibility of spark plug fouling, method 500 proceed to 524. Otherwise, method 500 proceeds to 530.

At 524, method 500 an increased amount of spark energy to deactivated engine cylinders. In one example, the amount of energy supplied to the spark plug is increased to an amount of energy that facilitates removal of matter from the spark plug. The amount of energy is greater than an amount of energy supplied to the spark plug at the present engine speed and load when all cylinders are operating and additional energy is not being supplied to remove matter from the spark plug. For example, X joules of energy is supplied to a spark plug when all engine cylinders are being operated at the present speed and load and X joules+Y joules of energy is supplied the spark plug to remove matter from the spark plug, noting that Y is positive and non-zero and engine torque is maintained at the present engine torque. By increasing the amount of energy supplied to spark plugs, method 500 may remove accumulated matter from spark plugs in the deactivated cylinders. The amount of spark energy supplied to cylinders that are not combusting an air-fuel mixture is greater than an amount of spark energy supplied to active engine cylinders. Method 500 proceeds to 526 after the amount of energy supplied to one or more spark plugs in deactivated cylinders is increased.

At 526, method 500 judges whether or not increased spark energy has been supplied to deactivated cylinders for a desired duration. The desired duration may be an amount of time or some other duration. Additionally, the desired or predetermined duration is varied depending on at least one engine condition (e.g., engine temperature, cylinder temperature, pressure in a cylinder). If method 500 judges that an increased amount of spark energy has been provided for a threshold duration, method 500 proceeds to 528. Otherwise, method 500 returns to 524.

At 528, method 500 stops spark delivery to the group of cylinders that are deactivated. Method 500 proceeds to 530 after cylinders in a group are deactivated.

At 530, method 500 judges whether or not to reactivate deactivated cylinders. The deactivated cylinders may be reactivated in response to an increase in engine speed and/or load or other conditions. In some examples, spark may be supplied deactivated cylinders at 530 for a predetermined amount of time or engine events before fuel is supplied to the deactivated cylinders so that fouling matter may be removed from spark plugs just before the deactivated cylinder are reactivated to combust air-fuel mixtures. The spark may be supplied at an energy level that is greater than if the engine were operating at the same engine speed and load without attempting to remove fouling matter from the spark plug. If method 500 judges to reactivate deactivated cylinders, method 500 proceeds to 532. Otherwise, method 500 returns to 514.

At 532, method 500 supplies spark and fuel to deactivated engine cylinders. The fuel amount in deactivated cylinders is increased to a level such that engine torque before and after transitioning from operating the engine with deactivated cylinders and operating the engine without deactivated cylinders is maintained at a substantially constant level. The amount of spark delivered to just reactivated cylinders may be an amount that is equal to amount of spark energy supplied to engine cylinders when matter that may foul spark plugs is not being removed while the engine is operating at the same engine speed and load. In some examples, the higher level of spark energy may be provided to reactivated cylinders for a predetermined amount of time or engine events to reduce the possibility of misfire. Method 500 proceeds to exit after fuel and spark are provided to deactivated cylinders to reactivate the cylinders.

Thus, the method of FIG. 5 provides for a method for providing spark to an engine, comprising: operating a first group of cylinders and deactivating a second group of cylinders, the second group of cylinders deactivated via stopping spark and fuel flow to the second group of cylinders; and providing spark without providing fuel to a cylinder of the second group of cylinders a predetermined duration after the second group of cylinders is deactivated. The method includes where the second group of cylinders is one or more cylinders, and where the spark is provided to the second group of cylinders after a predetermined number of engine or cylinder cycles after the second group of cylinders is deactivated. The method includes where after the second group of cylinders is deactivated, spark is provided without providing fuel to a cylinder of the second group of cylinders a predetermined duration after the second group of cylinders is deactivated during a first condition, and where the spark and fuel are provided to the cylinder of the second group of cylinders a predetermined duration after the second group of cylinders is deactivated during a second condition.

In some examples, the method includes where the second group of cylinder is deactivated in response to engine load, the engine is operated at a speed and load, and where an amount of ignition energy provided to the cylinder is greater than when the engine is operated at the same speed and load while supplying both spark and fuel to the cylinder of the second group of cylinders. The method includes where the amount of ignition energy is increased via increasing an ignition coil charging time. The method includes where the amount of ignition energy is increased via supplying energy from two ignition coils. The method includes where the predetermined duration is varied depending on at least one engine condition. The method includes where the engine condition is engine temperature or a pressure in the cylinder.

In another example, the method provides spark to an engine, comprising: operating a first group of cylinders via combusting air-fuel mixtures in the first group of cylinders; operating a second group of cylinders via combusting air-fuel mixtures in the second group of cylinders; and increasing an amount of ignition energy provided to a cylinder of a second group of cylinders to in response to a request to deactivate the cylinder. The method further comprises deactivating the cylinder after providing the amount of ignition energy for a predetermined duration, the predetermined duration based on engine operating conditions before the request to deactivate the cylinder.

In some examples, the method further comprises reactivating the cylinder and operating the engine at a speed and load, and increasing an amount of ignition energy provided to the cylinder to an amount of energy that is greater than an amount of ignition energy if the engine had been operating at the speed and load for a predetermined amount of time since the cylinder was deactivated. The method further comprises deactivating the cylinder via stopping spark and fuel flow to the cylinder, operating the engine at a speed and load, and reactivating spark to the cylinder without reactivating fuel flow to the cylinder after a predetermined duration. The method includes where spark is reactivated to the cylinder and supplied with an amount of energy that is greater than when the engine is operated at the same speed and load while supplying both spark and fuel to the cylinder. The method includes where the amount of ignition energy provided to the cylinder is increased via increasing an ignition coil charging time.

As will be appreciated by one of ordinary skill in the art, routines described in FIG. 5 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, or alternative fuel configurations could use the present description to advantage.

The invention claimed is:

1. A method for providing spark to an engine, comprising: operating a first group of cylinders and deactivating a second group of cylinders, the second group of cylinders deactivated via stopping spark and fuel flow to the second group of cylinders, increasing an amount of ignition energy provided to a cylinder of the second group of cylinders in response to a request to deactivate the cylinder, and deactivating the cylinder after providing the amount of ignition energy for a predetermined duration, the predetermined duration based on engine operating conditions before the request to deactivate the cylinder; and providing spark without providing fuel to the cylinder of the second group of cylinders a predetermined duration after the second group of cylinders is deactivated.

2. The method of claim 1, where the second group of cylinders is one or more cylinders, and where the spark is provided to the second group of cylinders after a predetermined number of engine or cylinder cycles after the second group of cylinders is deactivated, the predetermined number of engine or cylinder cycles each occurring while the second group of cylinders is disabled.

3. The method of claim 1, where after the second group of cylinders is deactivated, spark is provided without providing fuel to the cylinder of the second group of cylinders a predetermined duration after the second group of cylinders is deactivated during a first condition, and where the spark and fuel are provided to the cylinder of the second group of cylinders a predetermined duration after the second group of cylinders is deactivated during a second condition.

4. The method of claim 1, where the second group of cylinders is deactivated in response to engine load, the engine is operated at a speed and load, and where an amount of ignition energy provided to the cylinder is greater than when the engine is operated at the same speed and load while supplying both spark and fuel to the cylinder of the second group of cylinders.

5. The method of claim 4, where the amount of ignition energy is increased via increasing an ignition coil charging time.

6. The method of claim 4, where the amount of ignition energy is increased via supplying energy from two ignition coils.

7. The method of claim 1, where the predetermined duration is varied depending on at least one engine condition.

8. The method of claim 7, where the engine condition is engine temperature or a pressure in the cylinder.

9. A method for providing spark to an engine, comprising:

operating a first group of cylinders via combusting air-fuel mixtures in the first group of cylinders;

operating a second group of cylinders via combusting air-fuel mixtures in the second group of cylinders;

increasing an amount of ignition energy provided to a cylinder of the second group of cylinders in response to a request to deactivate the cylinder; and deactivating the cylinder after providing the amount of ignition energy for a predetermined duration, the predetermined duration based on engine operating conditions before the request to deactivate the cylinder.

10. The method of claim 9, further comprising reactivating the cylinder and operating the engine at a speed and load, and increasing the amount of ignition energy provided to the cylinder to an amount of energy that is greater than an amount of ignition energy if the engine had been operating at the speed and load for a predetermined amount of time since the cylinder was deactivated.

11. The method of claim 9, further comprising deactivating the cylinder via stopping spark and fuel flow to the cylinder, operating the engine at a speed and load, and reactivating spark to the cylinder without reactivating fuel flow to the cylinder after a predetermined duration.

12. The method of claim 11, where spark is reactivated to the cylinder and supplied with an amount of energy that is greater than when the engine is operated at the same speed and load while supplying both spark and fuel to the cylinder.

13. The method of claim 9, where the amount of ignition energy provided to the cylinder is increased via increasing an ignition coil charging time, and further comprising deactivating the cylinder via stopping fuel flow to the cylinder, and reactivating the cylinder after deactivating the cylinder in response to a cylinder reactivation request, reactivating the cylinder including supplying spark to the cylinder at an energy level that exceeds a spark energy level when operating the engine at a same speed and load without adding spark energy to remove fouling matter from a spark plug in the cylinder, the spark supplied to the cylinder a predetermined duration before resupplying fuel to the cylinder.

14. A system for providing spark to an engine, comprising:

an engine including a first group of cylinders and a second group of cylinders;

an ignition system including a first group of spark plugs positioned in the first group of cylinders and a second group of spark plugs positioned in the second group of cylinders; and a controller including executable instructions stored in non-transitory memory for increasing an amount of ignition energy provided to a cylinder of the second group of cylinders based on engine operating conditions before a request to deactivate the cylinder and deactivating the cylinder after providing the amount of ignition energy, and further instructions for supplying spark and fuel to the first and second groups of cylinders, deactivating the second group of cylinders via stopping spark and fuel flow in the second group of cylinders, operating the engine at a speed and load while the second group of cylinders is deactivated, and increasing the amount of ignition energy supplied to the second group of cylinders after deactivating the second group of cylinders without flowing fuel to the second group of cylinders, the amount of ignition energy increased to an amount of ignition energy that is greater than if the engine is operating at the speed and load with the first and second group of cylinders activated.

15. The system of claim 14, where the amount of ignition energy supplied to the second group of cylinders is increased after a predetermined duration since deactivating the second group of cylinders.

16. The system of claim 15, where the predetermined duration is a number of engine cycles.

17. The system of claim 16, where the number of engine cycles varies with engine operating conditions.

18. The system of claim 14, further comprising additional instructions for increasing the amount of ignition energy in response to a request to deactivate the second group of cylinders while the second group of cylinders is operating.

19. The system of claim 14, where the ignition system includes two ignition coils per spark plug.

* * * * *